US006035974A

United States Patent [19]

Richter et al.

[11] Patent Number: 6,035,974

[45] Date of Patent: Mar. 14, 2000

[54] MODULAR CONSTRUCTION FOR ELEVATORS

[75] Inventors: Utz Richter, Ebikon; Christoph Liebetrau, Menziken, both of Switzerland

[73] Assignee: Invento AG, Hergiswil NW, Switzerland

[21] Appl. No.: 08/982,633

[22] Filed: Dec. 2, 1997

[30] Foreign Application Priority Data

Dec. 3, 1996 [EP] European Pat. Off. ..... 96810843

[51] Int. Cl.[7] ..... B66B 11/08; B66B 17/12; B66B 7/02

[52] U.S. Cl. ..... 187/404; 187/406; 187/254

[58] Field of Search ..... 187/404, 406, 187/254

[56] References Cited

U.S. PATENT DOCUMENTS 5,490,578 2/1996 Aulanko et al. ..... 187/254
5,833,031 11/1998 Liebtrau et al. ..... 187/404 X

FOREIGN PATENT DOCUMENTS 0 631 968 1/1995 European Pat. Off. .
0 710 618 5/1996 European Pat. Off. .
0 745 550 12/1996 European Pat. Off. .
0 745 553 12/1996 European Pat. Off. .
1 521 441 8/1968 France .
405070057 3/1993 Japan ..... 187/404

*Primary Examiner*—Christopher P. Ellis
*Assistant Examiner*—Gene O. Crawford
*Attorney, Agent, or Firm*—MacMillan, Sobanski & Todd, LLC

[57] ABSTRACT

A modular, prefabricated elevator includes column-like guide modules (10) extending between a foundation module (13) and a head module (2) and attached to a building by fastening modules (11), and an elevator car (5) that is connected by support cables (3) with counterweights (9) running in the guide modules (10). A stationary drive for the car (5) is in the form of one or two drive modules (12) combined with the head module (2) or with the foundation module (13) and integrated into the modular system in this manner. Through appropriate selection of the number of drive modules (12), the mode of suspension and the motor power, a wide range of use is covered with respect to conveying load and speed.

14 Claims, 8 Drawing Sheets

MODULAR CONSTRUCTION FOR ELEVATORS

BACKGROUND OF THE INVENTION

The present invention relates to a prefabricatable elevator of modular construction for the transport of persons and/or goods, which elevator is connectable with a wall of a building having elevator shaft doors, and essentially consists of a foundation module, a head module, column-like guide modules and an elevator car, and preferably has counterweights which are guided in the guide modules.

Due to the power capability and variability this elevator type is suitable for both small and high buildings. The field of use ranges from small goods elevators to bed elevators for hospitals or the like.

An add-on elevator of the kind stated in the introduction is described in the European patent application No. 96 108 133.8, wherein the car is constructed as a vertical self-propelled transport unit by means of a friction wheel drive arranged under the car.

The advantage of self-propelled elevator cars consists in that no motor room is needed and several cars can run in the same shaft. On the other hand, the drive must be carried along permanently.

SUMMARY OF THE INVENTION

The present invention concerns a prefabricated elevator of modular construction that is connectable with a building wall having shaft doors at floors, the elevator including a foundation module, a head module, a pair of column-like guide modules extending between the head module and the foundation module, and an elevator car travelling between the guide modules and being connected to counterweights which are guided by the guide modules, a drive for the elevator car including: at least one drive module that is adapted to be combined selectively with the head module and with the foundation module, a drive pulley connected to and rotated by the drive module, and a support cable connected to the elevator car and engaging the drive pulley for moving the elevator car.

The present invention provides a drive for an elevator car, in which equally no motor room is required and in which the drive unit does not need to be carried along with the elevator car. In that case, a modular construction allows the factory production of complete elevator systems with various carrying capacities and for different building heights.

The invention includes a stationary drive constructed as a component of the modular system and as such forms a drive/head module or a drive/foundation module.

The drive module is constructed as a carrying part of a drive/head module or of a drive/foundation module.

The stationary drive, constructed as a drive/head module or drive/foundation module, has two drive shafts each with a respective drive pulley.

The outwardly departing drive shafts run in a protective tube and are mounted again at the outer end thereof, wherein the protective tube end is supported in an opening of the guide module without additional element parts.

An arrangement of the drive pulleys directly over the guide modules saves any additional deflecting rollers.

A slender elongated drive requires only a small constructional height, so that, when the elevator is, for example, installed in an existing shaft this shaft does not have to be extended upwardly for drive reasons.

The stationary drive can be divided into two individual drives for, for example, doubling of power, wherein each of the two drives is associated with a guide module and can be constructed as a double-drive/head module or double-drive/foundation module.

A drive/head module or a drive/foundation module can be combined with guide modules, fastening modules and a head or foundation module into a self-supporting frame, which forms a unit transportable from the factory to a building by trucks or by rail.

A loading, which is equalized about the transverse axis, of the head module is achieved by a mutually opposite arrangement of the individual drives at the head module.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
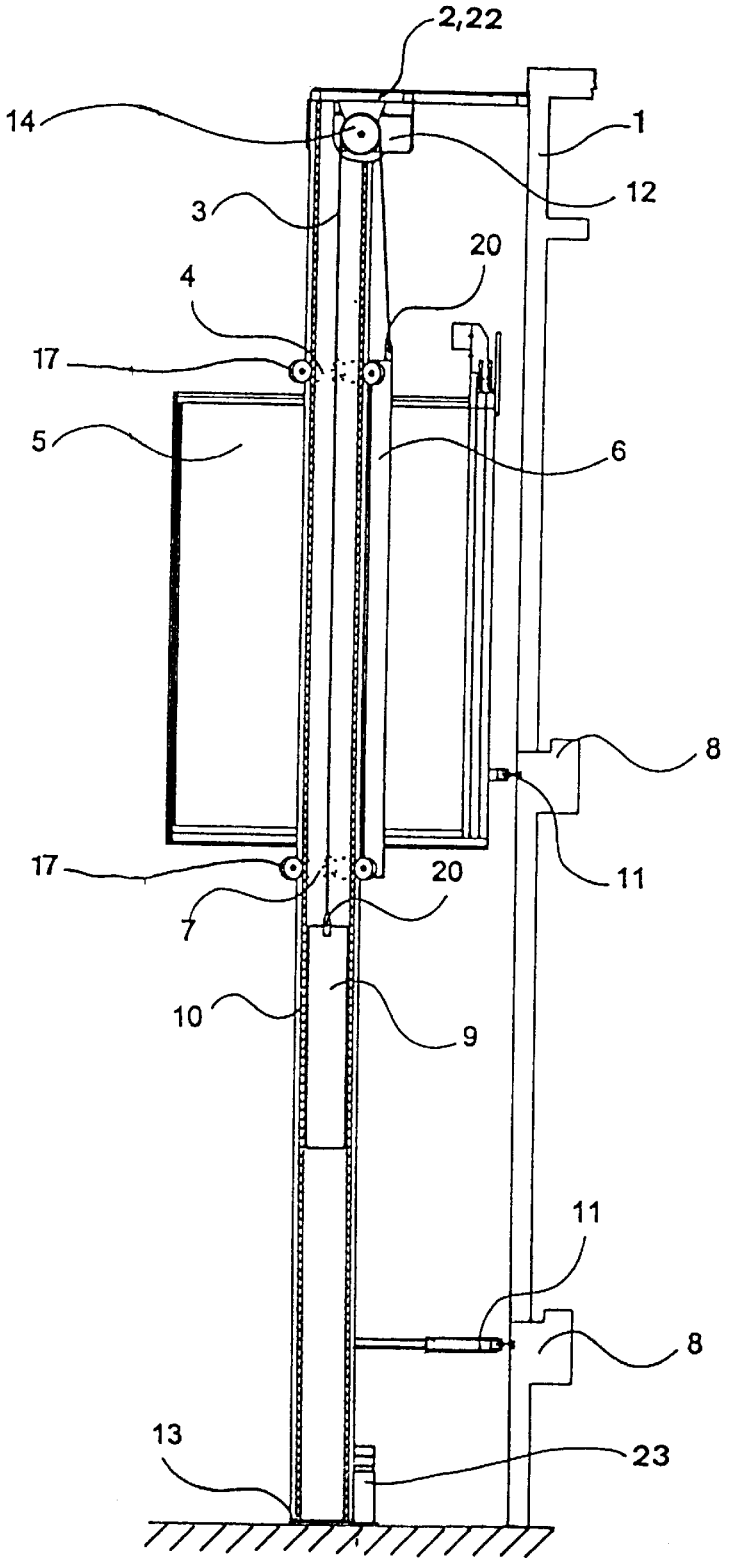
FIG. 1 is a left side view of an elevator with a stationary drive as head module in accordance with the present invention.

In the FIG. 1, a building wall 1 is shown adjacent to which an elevator car 5 travels up and down guided by two column-like guide modules 10. An elevator shaft as a constructional component of a building and as a support of mounting brackets for guide rails of the car and of the counterweight, as well as of further items of apparatus specific to an elevator, is not absolutely necessary. The guide modules 10 extend over several floors 8 and are at the most about eighteen meters long according to the proposed transport path. Through insertion of several elements into one another even higher structures up to one hundred meters and more can be realized thereby without further measures.

The elevator car 5 includes guide rollers 17 mounted at an upper yoke 4 and at a lower yoke 7, as well as a cable end fastening 20 at the upper yoke 4. The upper yoke 4 and the lower yoke 7 are vertically connected with a catch frame 6. The guide modules 10 are connected at the floors 8 with the building by means of fastening modules 11. The guide modules 10 are transversely connected at the bottom with a foundation module 13 and put down on the shaft base. The foundation module 13 moreover carries one or two buffers 23. At the top, the guide modules 10 are transversely connected with a head module 2, wherein the head module 2 here carries a drive module 12 and, in this combination, is designated as a drive/head module 22. The drive module 12 includes lateral drive pulleys 14, over which respective support elements such as cables 3 are looped, which cables are connected with the elevator car 5 and with counterweights 9, which run in the guide modules 10, by way of the two cable end fastenings 20. Of the two drive pulleys 14, only one thereof is visible in the FIG. 1. The same applies to the guide modules 10 and the counterweights 9. The guide modules 10 can be constructed as profile members shaped in any desired manner, with or without guides for a counterweight.

Figure 2:
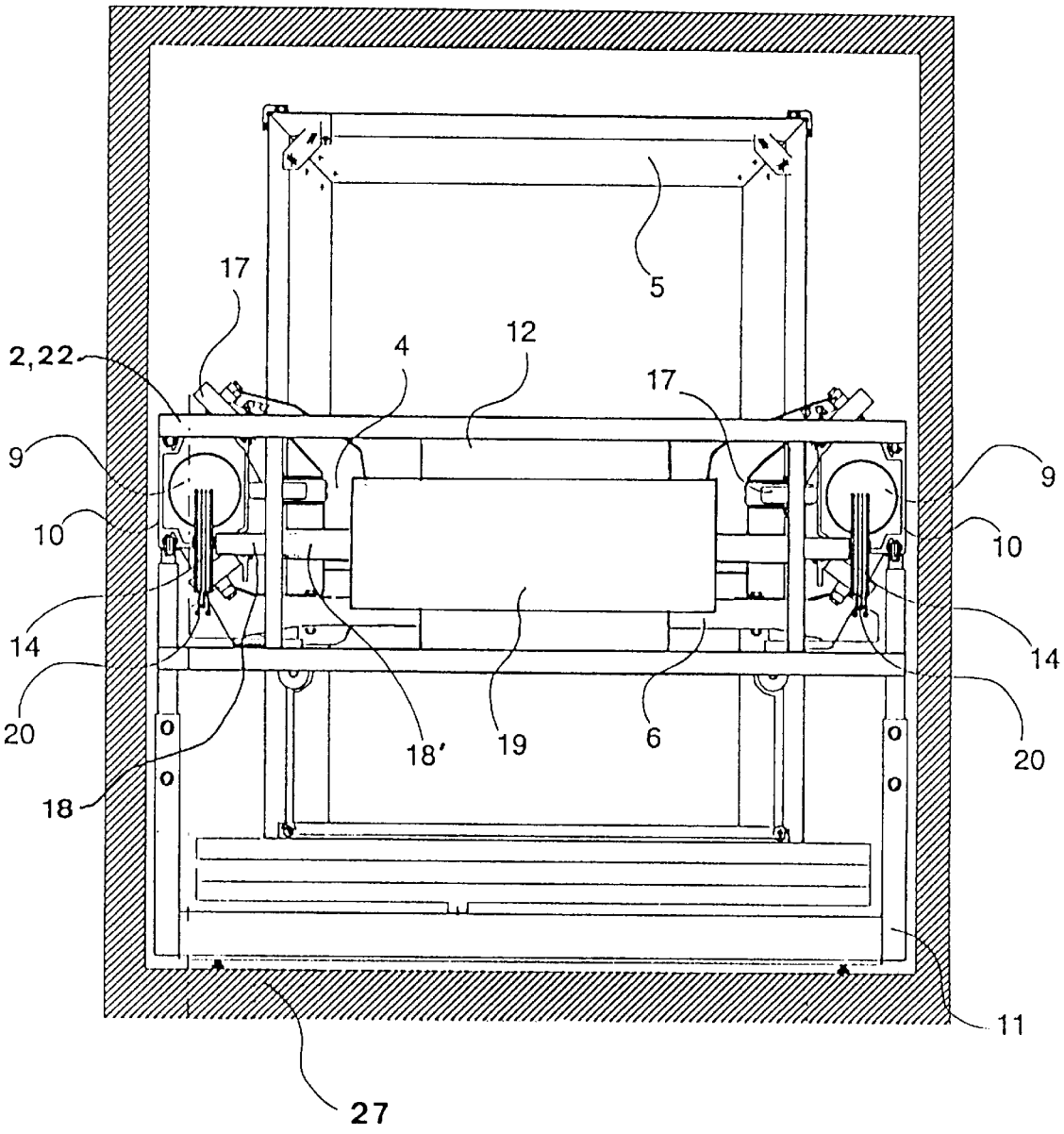
FIG. 2 is a top plan view of the elevator shown in the FIG. 1.

In FIG. 2, the modularly constructed elevator is arranged in an elevator shaft 27. There are recognizable, seen from above, further details of the drive/head module 22. This includes the drive module 12, which is centrally arranged between two parallel crossbeams, with a motor 19. This has drive shafts 18, which extend outwardly at both sides and at each of which a respective one of the drive pulleys 14 is mounted at the outer end. The drive shafts 18 are provided with a protective tube 18', wherein the protective tube has a shaft bearing at the outer end behind the drive pulley 14. For the purpose of support of this bearing location, the protective tube is guided at this outer end in a corresponding recess in the guide module 10, whereby the vertical force of the suspended load with the elevator car 5 and the counterweight 9 is thus conducted into the guide module 10, which is dimensioned to be resistant to bending. Due to this arrangement, no bending forces arise in the drive shafts 18. The drive module 12 is constructed as a load carrying part of the drive/head module 22 and thus replaces further stiffening struts between the crossbeams.

The drive module 12 includes, apart from the motor 19, a brake which is not illustrated and, if needed, a reduction gear which similarly is not illustrated. The drive module 12 is advantageously constructed as shown in the European patent application no. 96107861.5, which is declared as part of this application, i.e. constructed with a hollow rotor shaft, which leads to a slender, elongated mode of construction with a small diameter of the drive. Thus, with the additional use of the small drive pulleys 14 of one hundred fifty to three hundred millimeter diameter and preferably aramide cables only very little horizontal constructional height is needed. The departing support cables 3 of the drive pulleys 14 lead virtually without diagonal tension in the center of the guide modules 10 to the counterweights 9 on the one side and to the cable end fastenings 20 on the lateral arm of the catch frame 6 of the elevator car 5.

Figure 3:
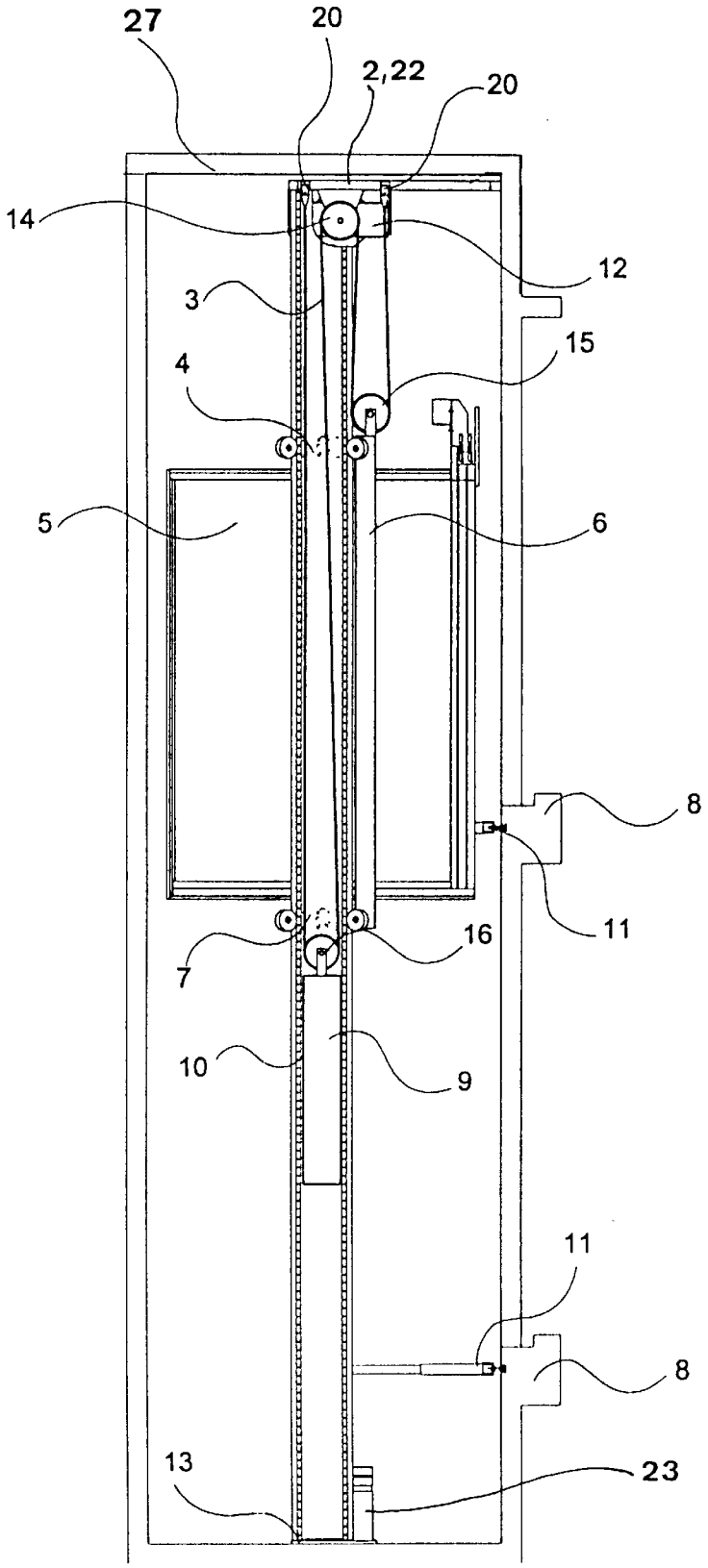
FIG. 3 is a view similar to the FIG. 1 showing a variation having a 2:1 suspension of the car and counterweight.
Figure 4:
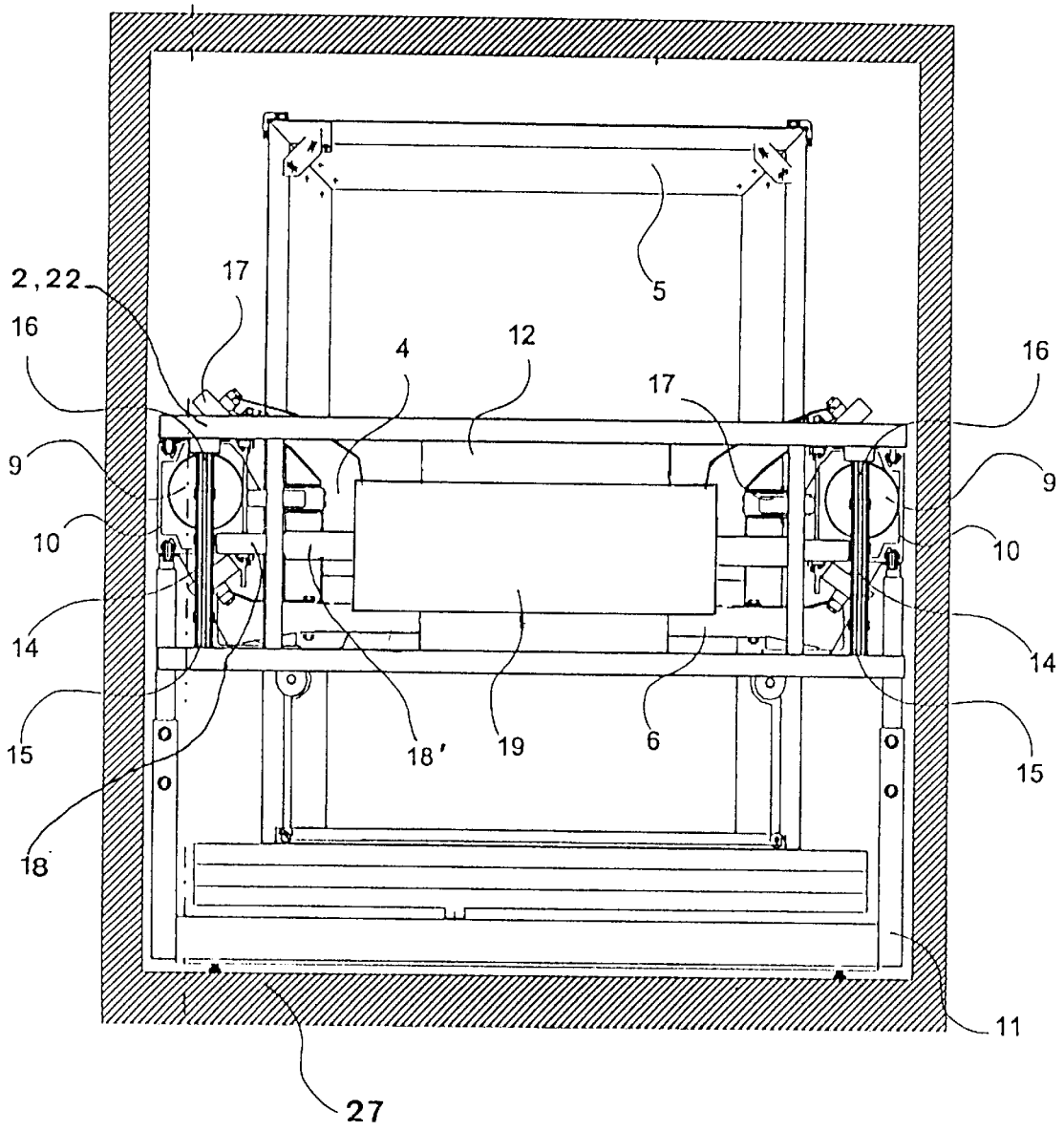
FIG. 4 is a top plan view of the elevator shown in the FIG. 3.

The FIGS. 3 and 4 show in principle the same arrangement of the drive module 12 as in the preceding dispositions. However, the difference from these consists in that here the elevator car 5 and the counterweights 9 are suspended in a 2:1 ratio. For this purpose, deflecting rollers 15 are present on the elevator car 5 and deflecting rollers 16 on the counterweights 9. Moreover, the cable end fastenings 20 are disposed at the drive/head module 22. With this variation a reduction gear in the drive module 12 can be dispensed with in many cases, whereby an even better efficiency is achieved with lower costs. This variation is provided for any cases of use where larger loads are to be conveyed at small to medium speeds.

Figure 5:
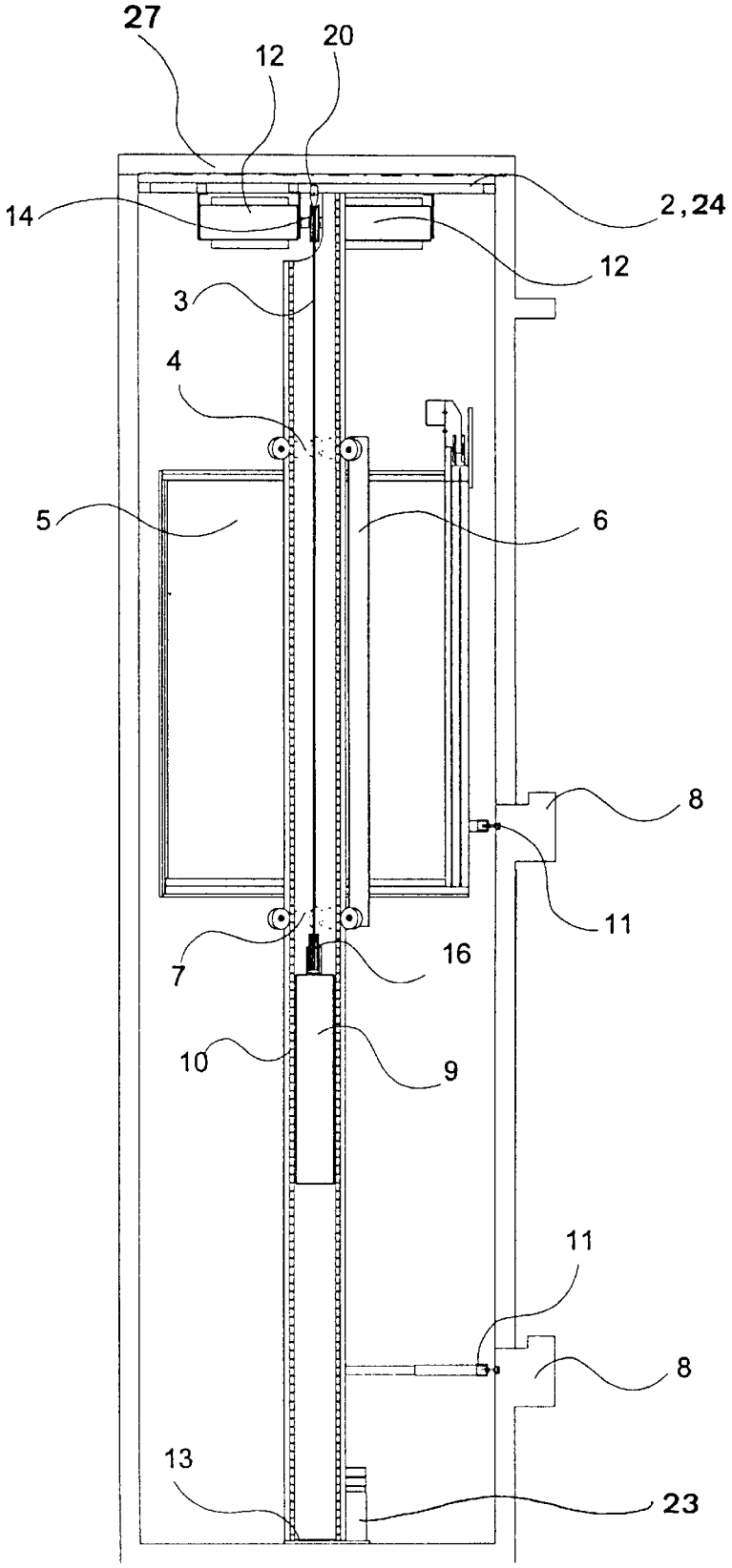
FIG. 5 is a view similar to the FIG. 1 showing a second variation having a divided stationary drive disposed at the top.
Figure 6:
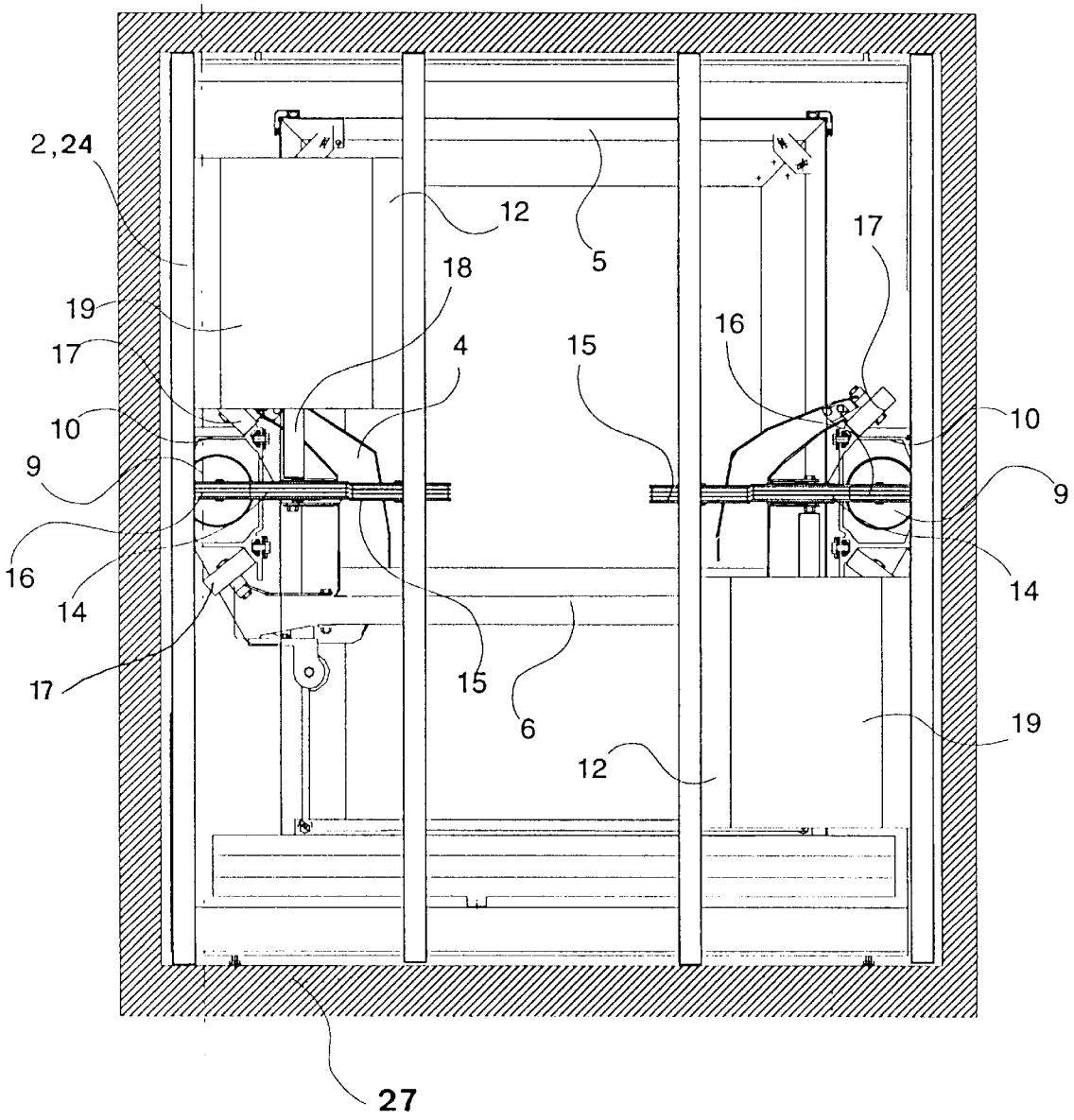
FIG. 6 is a top plan view of the elevator shown in the FIG. 5.

A second variation according to the FIGS. 5 and 6 shows a further possibility how the power range of the elevator installation according to the present invention can be still further enlarged upwardly. For this purpose, the drive modules 12 are used twofold, one each above the left and the right guide module 10. The two drive modules 12 are, by means of a suitable cantilever construction which is not illustrated in detail, fixedly connected with the head module 2 and in that manner form a double-drive/head module 24. In the shown illustration, the elevator car 5 and the counterweights 9 are in addition suspended in the ratio 2:1, which, with halved speed, results in the logical doubling of the carrying force. In the shown illustration, the two drive modules 12 are arranged opposite to one another. This has as its object a load torque equalization about the transverse axis at the head module 2 or double-drive/head module 24. In the case of use of the drive module 12 for a double drive, the motor 19 has only one outwardly departing shaft 18 with the drive pulley 14.

Figure 7:
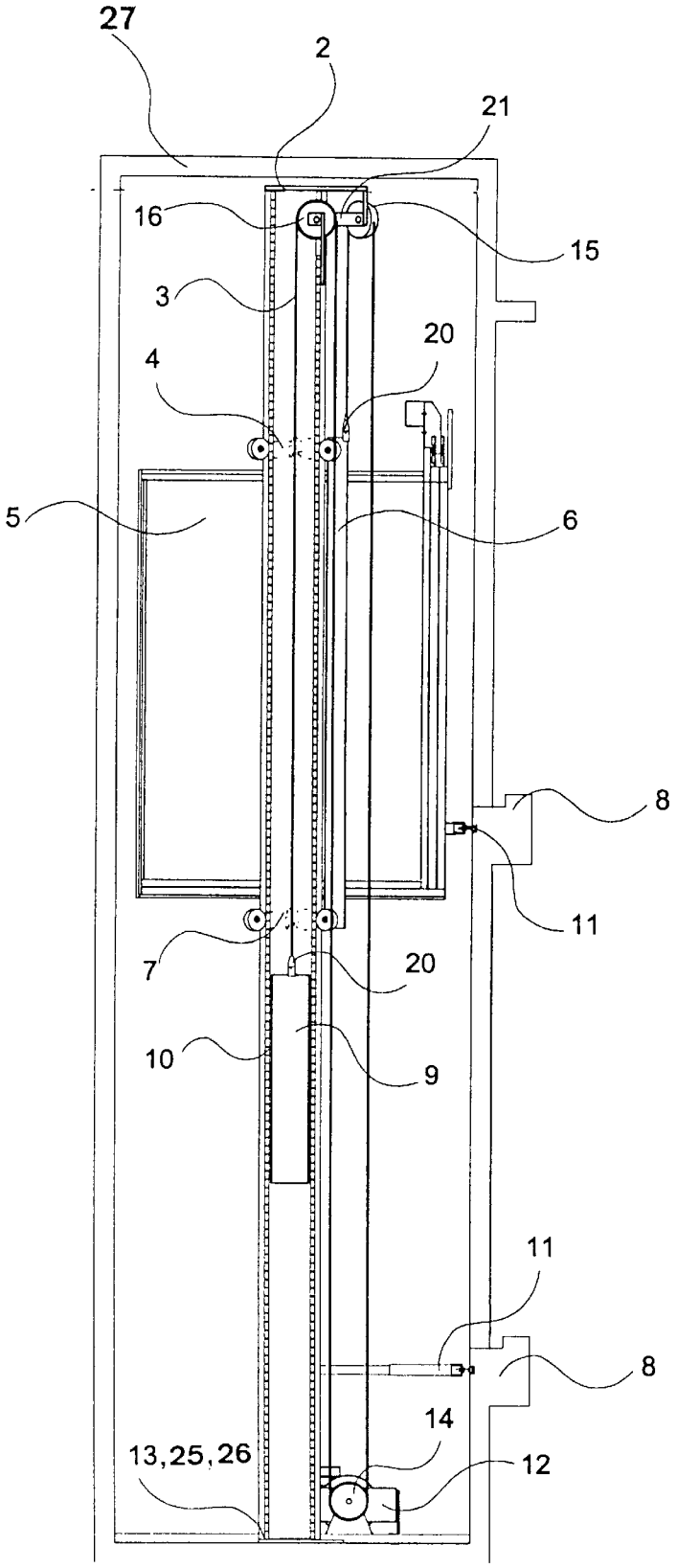
FIG. 7 is a view similar to the FIG. 1 showing third variation having a divided stationary drive disposed at the bottom.
Figure 8:
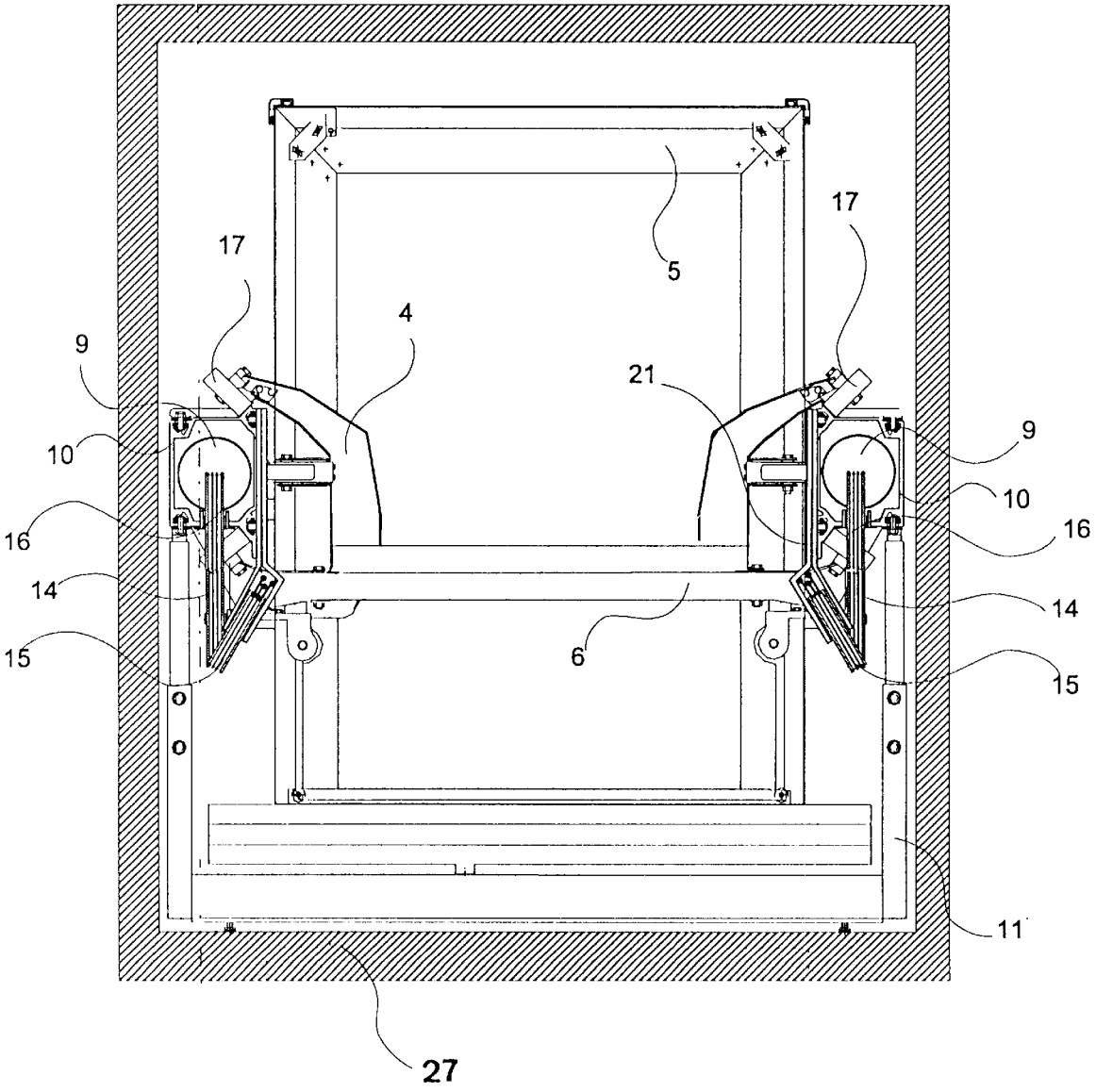
FIG. 8 is a top plan view of the elevator shown in the FIG. 7.

As a third variant, the FIGS. 7 and 8 show an elevator with a drive lying at the bottom. In that case, the drive module 12 is fixedly connected with the foundation module 13 and the support cables 3 are guided over the deflecting rollers 15 and 16 at the head module 2 to the elevator car 5 and to the counterweights 9, wherein the roller 15 is provided as the deflecting roller for the elevator car 5 and the roller 16 as the deflecting roller for the counterweights 9. The deflecting rollers 15 and 16 are each fastened to a respective guide module 10 by means of a fastening bracket 21. The foundation module 13 is thus a drive/foundation module 25. A 1:1 suspension ratio for the elevator car 5 and the counterweights 9 is shown. However, it is also possible to realize a 2:1 suspension ratio with a drive lying at the bottom. Equally, a doubling of the drive power can be achieved in that, as with the drive lying at the top, two drive modules 12 are provided and thus form a double-drive/foundation module 26.

The illustrated examples show the possibilities of adaptation of a modular system to a wide range of requirements with respect to conveying load and speed. In that case, a large number of the same modules can be used for all variants of disposition. The adaptations of performance with respect to carrying force and speed can be varied by the number of drive modules 12, with and without reduction gear, as well as combined with the mode of suspension ratio of 1:1 or 2:1. In the case of use of motors 19 with different output, even greater ranges of use are opened up with respect to carrying force and speed.

In the case of double drives it is ensured by an appropriate motor regulation, for example with equal desired values of speed and torque, that equal tension forces prevail on both sides. A mechanical coupling can also be provided with suitable means, for example with chain and sprockets, as constrained synchronization of the two drives.

The slender, elongated form of the drive/head module 22 or drive/foundation module 25 makes it possible to arrange the guide modules 10, by very short fastening modules 11, quite near the building, whereby the arising horizontal forces are then accepted by the building structure. Thus, the present modular system is also suitable for the realization of 'rucksack' lifts.

An installation of the elevator according to the invention in the shaft 27 does not result in any changes of the disposition in terms of modularity. Existing shaft walls then serve only as breastwork and are not burdened with fastening brackets. The elevator can then be brought up as a complete prefabricated unit, inserted from above into the still open shaft 27 and then be fastened to the shaft door wall thereof In summary, the present invention concerns a prefabricated elevator of modular construction that is connectable with a building wall 1 having shaft doors at floors 8, the elevator including the foundation module 13, the head module 2, the pair of column-like guide modules 10 extending between the head module and the foundation module, and the elevator car 5 travelling between the guide modules and being connected to counterweights 9 which are guided by the guide modules. The drive for the elevator car 5 includes at least one drive module 12 that is adapted to be combined selectively with the head module 2 and with the foundation module 13, the drive pulley 14 connected to and rotated by the drive module, and the support cable 3 connected to the elevator car 5 and engaging the drive pulley for moving the elevator car.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an elevator of modular construction that is connectable with a building wall having shaft doors at floors, the modular elevator including a foundation module, a head module, a pair of column-like guide modules extending between the head module and the foundation module, and an elevator car travelling between the guide modules and being connected to counterweights which are guided by the guide modules, a drive for the elevator car comprising:

a drive module adapted to be connected to one of a head module and a foundation module of a modular elevator, said drive module including a motor having a pair of outwardly departing drive shafts;

a pair of drive pulleys each connected to and rotated by a respective one of said drive shafts;

a support cable adapted to be connected to an elevator car travelling between guide modules extending between the head module and the drive module and engaging said drive pulley for moving the elevator car; and each of said drive shafts being enclosed by a protective tube with a shaft bearing, which is supported in one of the guide modules behind said drive pulley.

2. In a modular elevator that is connectable with a building wall having shaft doors at floors, the elevator including a foundation module, a head module, a pair of column-like guide modules extending between the head module and the foundation module, and an elevator car travelling between the guide modules and being connected to at least one counterweight which is guided by one of the guide modules, a drive for the elevator car comprising:

at least one drive module adapted to be connected to one of a head module and a foundation module of a modular elevator having column-like guide modules extending between the head module and the foundation module, said drive module including at least one motor with at least one outwardly extending drive shaft, said drive shaft being enclosed by a protective tube with a shaft bearing, said shaft bearing being supported in one of the guide modules;

at least one drive pulley connected to said drive shaft and rotated by said motor, said shaft bearing being supported behind said drive pulley; and a support cable connected to an elevator car and engaging said drive pulley for moving the elevator car travelling between the guide modules.

3. The elevator drive according to claim 2 wherein said drive module is constructed as a load carrying part of one of the head module and the foundation module to form one of a drive/head module and a drive/foundation module respectively.

4. The elevator drive according to claim 2 wherein said drive module includes a motor with a pair of outwardly extending drive shafts each with one of said drive pulley attached thereto, each of said drive shafts being enclosed by a protective tube with a shaft bearing, which shaft bearing is supported in the respective guide module behind said drive pulley.

5. The elevator drive according to claim 2 wherein said drive module includes a motor having two drive shafts extending coaxially and connected to a pair of said drive pulleys each engaging one of a pair of said support cables connected to the elevator car.

6. The elevator drive according to claim 2 wherein said drive module has a slender, elongated form and said drive pulley is approximately 150 to 300 millimeters in diameter.

7. The elevator drive according to claim 2 including two drive pulleys connected to said drive module and each engaging an associated one of a pair of said support cables connected to the elevator car.

8. The elevator drive according to claim 7 wherein said drive pulleys are arranged directly over the column-like guide modules.

9. The elevator drive according to claim 2 wherein said drive module is a double-drive module having a separate motor associated with each of the guide modules, each motor having an outwardly extending drive shaft connected to one of said drive pulleys.

10. The elevator drive according to claim 9 wherein said double-drive module includes a pair of motors mounted axially parallel in mutually opposite directions.

11. The elevator drive according to claim 10 wherein the modular elevator includes a plurality of fastening modules for attaching the guide modules to walls of an elevator shaft and said drive module is one of a drive/head module, a double-drive/head module, a drive/foundation module and a double-drive/foundation module whereby when said drive module is connected with the guide modules, the fastening modules and one of the head module and the foundation module, a self-supporting frame is formed that is easily transported from a fabrication site to an installation site.

12. An elevator of modular construction that is connectable with a building wall having shaft doors at floors, the elevator comprising:

a foundation module;

a head module;

a pair of column-like guide modules extending between said head module and said foundation module;

an elevator car mounted for travel between said guide modules;

at least one counterweight which is guided by one of said guide modules;

at least one drive module connected to one of said head module and said foundation module; and at least one drive pulley connected to and driven by said drive module and engaging a support cable connected between said elevator car and said counterweight wherein said drive module includes at least one motor with at least one outwardly extending drive shaft with said drive pulley attached thereto, said drive shaft being enclosed by a protective tube with a shaft bearing, said shaft bearing being supported in said one guide module behind said drive pulley.

13. The elevator according to claim 12 wherein said drive module connected to said head module and forms a drive/ head module having at least one drive motor connected to said drive pulleys.

14. The elevator according to claim 12 wherein said drive module connected to said foundation module and forms a drive/foundation module having at least one drive motor connected to said drive pulleys.

* * * * *